US011772937B2

(12) United States Patent
MacKenzie-Smith et al.

(10) Patent No.: US 11,772,937 B2
(45) Date of Patent: Oct. 3, 2023

(54) ELEVATOR CAR DOOR CONTROL SYSTEM

(71) Applicant: G.A.L. Manufacturing Company, LLC, Bronx, NY (US)

(72) Inventors: Charles MacKenzie-Smith, Astoria, NY (US); Matthew Perillo, Brooklyn, NY (US); Stephen Bosshart, Brooklyn, NY (US); Andrew Goodwin, New York, NY (US)

(73) Assignee: G.A.L. Manufacturing Company, LLC, Bronx, NY (US)

( * ) Notice: Subject to any disclaimer, the term of this patent is extended or adjusted under 35 U.S.C. 154(b) by 0 days.

(21) Appl. No.: 17/680,611

(22) Filed: Feb. 25, 2022

(65) Prior Publication Data

US 2023/0271810 A1 Aug. 31, 2023

(51) Int. Cl.

| | |
|---|---|
| ***B66B 13/20*** | (2006.01) |
| ***B66B 13/18*** | (2006.01) |
| ***B66B 13/12*** | (2006.01) |
| ***B66B 13/08*** | (2006.01) |

(52) U.S. Cl.

CPC ..... *B66B 13/20* (2013.01); *B66B 13/12* (2013.01); *B66B 13/185* (2013.01); *B66B 13/08* (2013.01)

(58) Field of Classification Search

CPC ..... B66B 13/20; B66B 13/12; B66B 13/08
See application file for complete search history.

(56) References Cited

U.S. PATENT DOCUMENTS

| | | | |
|---|---|---|---|
| 3,056,470 | A | 10/1962 | Moser et al. |
| 3,912,049 | A | 10/1975 | Holland et al. |
| 4,364,454 | A | 12/1982 | Glaser et al. |
| 4,423,799 | A | 1/1984 | Glaser et al. |
| 4,491,200 | A | 1/1985 | Thompson et al. |
| 4,926,975 | A | 5/1990 | Morris |
| 4,947,964 | A | 8/1990 | Husmann |
| 5,730,254 | A | 3/1998 | Nguyen |
| 5,819,877 | A | 10/1998 | Rivera et al. |
| 5,918,706 | A | 7/1999 | Kowalczyk et al. |
| 6,220,396 | B1 | 4/2001 | Heath, III |
| 6,508,332 | B2 | 1/2003 | Fahl et al. |

(Continued)

FOREIGN PATENT DOCUMENTS

| | | |
|---|---|---|
| EP | 0332841 B1 | 4/1992 |
| EP | 1524233 B1 | 11/2006 |

(Continued)

*Primary Examiner* — Diem M Tran
(74) *Attorney, Agent, or Firm* — Lerner David LLP

(57) ABSTRACT

An elevator car door control system includes a clutch and an interlock assembly. The clutch may include a stationary base and a slidable base movably attached to the stationary base. The stationary base may be adapted for attachment to a car door of an elevator car. The interlock assembly may include a locking arm operatively connected to the slidable base of the clutch and moveable from a locked position preventing translation relative to the elevator car to an unlocked position. When the car door is in a closed position, a door opening sequence may commence causing the slidable base to move relative to the car door, but the car door will only open if the slidable base presses against an object, such as a roller on a hoistway door, in which case the locking arm of the interlock assembly moves from the locked to the unlocked position.

20 Claims, 6 Drawing Sheets

(56) References Cited

U.S. PATENT DOCUMENTS

| | | | | |
|---|---|---|---|---|
| 2007/0227829 | A1 | 10/2007 | Christen | |
| 2021/0316962 | A1 * | 10/2021 | Kashiwakura | B66B 13/12 |

FOREIGN PATENT DOCUMENTS

| | | | | | |
|---|---|---|---|---|---|
| EP | 1820767 | A1 | | 8/2007 | |
| FR | 2823495 | A1 | * | 10/2002 | B66B 13/20 |
| WO | WO-2008078135 | A1 | * | 7/2008 | B66B 13/12 |
| WO | 2020049684 | A1 | | 3/2020 | |

* cited by examiner

ELEVATOR CAR DOOR CONTROL SYSTEM

BACKGROUND OF THE DISCLOSURE

Various systems have been developed over time to prevent an elevator car door from opening when doing so would be unsafe or otherwise inappropriate, such as under a condition where the elevator car is in between floors of a building. However, such systems, to the extent they prevent car doors from fully opening, have required that the door open slightly prior to triggering a mechanism that prevents the door from opening further. Additionally, where existing elevator cars have included a built-in gate switch to prevent an elevator car from travelling when its door or doors are already open, such gate switch has been incorporated as an entirely separate structure on the elevator car relative to an apparatus that prevents the car door from fully opening under unsafe conditions.

Thus, a need exists for improved elevator car door control systems that optimize the opening and closing of an elevator car door based on an existing condition of an elevator car.

BRIEF SUMMARY OF THE DISCLOSURE

In some embodiments, the present disclosure relates to an elevator car door control system that prevents an elevator car door from opening when, among other conditions, an elevator car is in between floors in a building hoistway. Further, when operational, one advantage of the control system is that the car door does not open at all before triggering the mechanism that prevents the car door from fully opening. Additionally, the control system incorporates a built-in switch, so advantageously, an elevator car equipped with the contemplated control system does not require a separate gate switch. This combination of features provides integrated mechanical and electrical locking.

In one aspect, the present disclosure relates to an elevator car door control system. In a first embodiment, an elevator car door control system includes a clutch and an interlock assembly. The clutch may include a stationary base configured for mounting onto an elevator car door and a slidable base mounted on the stationary base. The system may further include a close vane attached to the stationary base and a sensing vane movably attached to the slidable base. Additionally, the clutch may also include a control link operatively connected to the sensing vane, the control link only moving vertically when a physical object presses against the sensing vane to apply force to the sensing vane. The interlock assembly may include a support block configured for slidable attachment to a rail above an elevator car, a fixed locking frame and a locking arm removably received in the locking frame. The clutch may be operatively connected to the interlock assembly through a translation arm. More specifically, the control link of the clutch may be connected to the translation arm such that when at least part of the control link translates vertically, the translation arm translates in a corresponding manner.

In a second example of the first embodiment, the control link is an interlock control arm with a slot therethrough, and the sensing vane includes a pin connected thereto that is positioned through the slot. In a third example of the first embodiment, the control link of the second example is rotatably fixed to the stationary base at a first end so that when a physical object presses against the sensing vane, the control link rotates about the first end so that a second end opposite the first end rises, thereby raising locking arm from a locked position to an unlocked position. In a fourth example, the control link of the third example rotates about the first end when the slidable base is translated to a location proximate the close vane and the sensing vane presses against a physical object.

In a second embodiment, an elevator car door control system includes a clutch, a translation arm and an interlock assembly. The clutch is attached to an elevator car door of an elevator car and may include a stationary base, a slidable base movably attached to the stationary base, a close vane attached to the stationary base, an interlock control arm with a first end rotatably attached to the stationary base, and a sensing vane movably attached to the slidable base. The translation arm is operatively connected to the interlock control arm. The interlock assembly may include a support block and a locking arm rotatably attached to the support block at a first location on the locking arm and rotatably attached to the translation arm at a second location on the locking arm separate from the first location. The locking arm may include a protruding tip at an end of the locking arm remote from the first location. When a door operating mechanism of the elevator car receives a signal to open the elevator car door from a closed position, rotation of a lever linking the door operating mechanism to the clutch causes the slidable base to translate toward the close vane. When there is no physical object between the sensing vane and the close vane upon receiving the signal, an angulation of the interlock control arm relative to the stationary base remains unchanged before and after the slidable base slides toward the close vane. And, when there is a physical object between the sensing vane and the close vane upon receiving the signal, the angulation of the interlock control arm relative to the stationary base changes such that the translation arm translates toward a roof of the elevator car and the protruding tip of the locking arm moves relative to a top surface of the elevator car to release the interlock assembly from a locked position to an unlocked position.

In a second example of the second embodiment, the interlock assembly may also include a locking frame with a barrier having a switch, i.e., an electrical switch. The locking frame may be positioned such that the locking arm contacts the switch when the interlock assembly is in the locked position and the locking arm does not contact the switch when the interlock assembly is in the unlocked position. In a third example of the second embodiment, the protruding tip of the locking arm in the first or second example may be disposed over the barrier of the locking frame when the interlock assembly is in the locked position such that the interlock assembly cannot translate relative to the elevator car. In a fourth example of the second embodiment, the slidable base of any one of the first through third examples may be slidable relative to the stationary base over a predetermined range of the stationary base surface.

In a third embodiment, an elevator car door control system includes a clutch and an interlock mechanism. The clutch may include a stationary base and a slidable base movably attached to the stationary base, the stationary base being adapted for attachment to an elevator car door of an elevator car. The interlock mechanism may include a locking arm operatively connected to the slidable base of the clutch. The locking arm may be moveable such that in a first position, the interlock mechanism is fixed relative to the elevator car and in a second position, the interlock mechanism is movable relative to the elevator car. When the elevator car door is in a closed position, a door operating mechanism may be operable to perform an initial part of an opening sequence to cause the slidable base to translate relative to the stationary base without moving the elevator car door from the closed position. When the slidable base translates and contacts a roller on a hoistway door along an elevator shaft housing the elevator car, the locking arm of the interlock may move from the first position to the second position.

In a second example of the third embodiment, the interlock mechanism may also include a locking frame that includes a barrier with a switch. The locking frame may be positioned such that the locking arm contacts the switch when the interlock mechanism is in the first position and does not contact the switch when the interlock assembly is in the second position. In a third example of the third embodiment, the first or second example of the interlock mechanism may also include a block assembly adapted to translate along a surface of the elevator car. The locking arm may have a first end connected to the block assembly and a second end opposite the first end. The locking arm may be rotatable about the first end to move the interlock mechanism between the first and second position of the interlock mechanism. In a fourth example of the third embodiment, the elevator car door control system of any one of the first through third examples may also include a translation arm extending between the clutch and the locking arm of the interlock mechanism, the translation arm translating vertically based on movement between the first and second position of the interlock mechanism. In a variation of the fourth example, the translation arm may be connected to the locking arm between the first and second ends of the locking arm.

In a fourth embodiment, an elevator car door control system for an elevator car includes a clutch and an interlock assembly operative connected to the clutch. The clutch may include a stationary base, a close vane attached to the stationary base, a slidable base movably attached to the stationary base and a sensing vane movably attached to the slidable base. The slidable base may be moveable from a first position remote from the close vane to a second position proximate the close vane. The slidable base may be configured to move from the first position to the second position when operation of a door operating mechanism of the elevator car is initiated. The sensing vane may be moveable from an expanded position to a contracted position, the contracted position being closer to the slidable base than the expanded position. And, the sensing vane may be configured to move from the expanded position to the contracted position when a physical object applies force against a surface of the sensing vane. The interlock assembly may be operatively connected to the sensing vane of the clutch. When the slidable base is in the first position, the interlock assembly is in a locked position preventing a car door of the elevator car from opening. When the slidable base is in the second position and the sensing vane is in the expanded position, the interlock assembly is in the locked position. When the slidable base is in the second position and the sensing vane is in the contracted position, the interlock assembly is in an unlocked position.

In a second example of the fourth embodiment, the elevator car door control system may also include an interlock control arm rotatably attached to the stationary base and operatively connected to the sensing vane and the interlock assembly. The interlock control arm may be configured such that upon translation of the slidable base from the first position to the second position and the sensing vane moving from the expanded to the contracted position, a first end of the interlock control arm moves toward the interlock assembly thereby causing the interlock assembly to move from the locked to the unlocked position. In a third example based on the second example of the fourth embodiment, the interlock control arm may include a slot therein and the sensing vane may include an extension with a pin disposed within the slot. In a fourth example based on the third example of the fourth embodiment, the slot of the interlock control arm may have a first segment and a second segment adjacent to the first segment. The first segment may be narrower than the second segment, and the segments may be positioned such that the pin is disposed within the second segment when the slidable base is in the first position and the pin is disposed within the first segment when the slidable base is in the second position. In a fifth example based on the fourth example of the fourth embodiment, the slot may be shaped such that when the slidable base is in the second position and the sensing vane is in the contracted position, the first end of the interlock control arm is closer to the interlock assembly than when at least one of the slidable base and the sensing vane is in another position. In a sixth example based on the third example of the fourth embodiment, the interlock control arm may be oriented in a horizontal position when the interlock assembly is in the locked position and in a non-horizontal position when the interlock assembly is in the unlocked position. A horizontal direction may be considered to be a direction perpendicular to a direction of travel of the elevator car. A vertical direction may be considered a direction of travel of the elevator car. In a variation of the sixth example also based on the third example of the fourth embodiment, the interlock control arm may be oriented in a lowered position when the interlock assembly is in the locked position and in a raised position when the interlock assembly is in the unlocked position.

In a seventh example based on the second example of the fourth embodiment, a translation arm may be operatively connected to the interlock control arm and the interlock assembly. The translation arm may be configured to translate when the interlock assembly moves between the locked and unlocked positions. In an eighth example of the fourth embodiment, any one of the first through seventh examples may be arranged so that the sensing vane may be connected to the slidable base by a pair of link members such that movement of the sensing vane relative to the slidable base involves lateral translation and vertical translation. In a ninth example of the fourth embodiment based on any one of the first through eighth examples, when the slidable base translates from the first position to the second position and the sensing vane remains in the expanded position, the car door may remain closed without moving along with the slidable base. In a tenth example of the fourth embodiment based on any one of the first through ninth examples, movement of the sensing vane from the expanded to contracted position may cause a pivotable locking arm of the interlock assembly to disengage from a barrier along a path of translation of the interlock assembly so that the interlock assembly is translatable with the car door relative to the elevator car. In an eleventh example of the fourth embodiment based on any one of the first through tenth examples, the interlock assembly may include a switch. The switch may form part of a closed circuit when the interlock assembly is in the locked position and may form part of an open circuit when the interlock assembly is in the unlocked position. The elevator car shall be prevented from travel through a hoistway when the circuit is open.

In another aspect, the present disclosure relates to a method of controlling the opening and closing of an elevator car door of an elevator car. In a first embodiment, a method of controlling movement of an elevator car door with a locking control system is performed. In this method, the locking control system may include a clutch and an interlock mechanism operatively connected to the clutch. The clutch may include a stationary base attached to the elevator car door and a slidable base slidably attached to the stationary base. The method includes a step performed in response to rotation of a lever operatively connected to the slidable base of the clutch and controlled by operation of a door operating mechanism, with the lever being operatively connected to the door operating mechanism. In response to such rotation, the slidable base of the system slides relative to the stationary base from a first position at a first distance from a close vane of the clutch to a second position at a second distance from the close vane, the second distance being less than the first distance. When the slidable base approaches the second position and a physical object is located in between the slidable base and the close vane, a sensing vane operatively connected to the slidable base presses against the physical object and the sensing vane moves relative to the slidable base causing the interlock mechanism of the locking control system to release the elevator car door from a locked state to an unlocked state. When the slidable base approaches the second position and there is no physical object in between the slidable base and the close vane such that the sensing vane does not make contact with a physical object, the sensing vane does not move relative to the slidable base and the interlock mechanism remains in the locked state.

In a second example of the first embodiment, the sliding of the slidable base may occur in response to arrival of an elevator car including the elevator car door at a floor previously selected through a user interface inside the elevator car. In a third example of the first embodiment, when the sensing vane makes contact with the physical object in either of the first or second examples, the physical object is a hatch door roller attached to a hatch door located on an elevator shaft housing the elevator car. In a fourth example of the first embodiment, when the sliding of the slidable base causes the sensing vane to contact the physical object in any one of the first through third examples, the sensing vane may move towards the slidable base and upward relative to the slidable base to cause an arm of the interlock mechanism to become unblocked, thereby permitting the interlock mechanism to translate relative to an elevator car supporting the elevator car door in the unlocked state.

BRIEF DESCRIPTION OF THE DRAWINGS

A more complete appreciation of the subject matter of the present disclosure and of the various advantages thereof can be realized by reference to the following detailed description in which reference is made to the accompanying drawings in which.

DETAILED DESCRIPTION

The present disclosure is directed to apparatuses, systems and associated methods of use for improved elevator car door control. Elevator car door control in various embodiments of the present disclosure may be aided through the use of a control system.

One aspect of the present disclosure relates to a control system that may be mounted to an elevator car door. The control system operates such that the elevator car door does not need to slide at all relative to the elevator car frame prior to stopping the car door from opening when the elevator car is not within a predetermined distance of a floor landing in a building.

Figure 1:
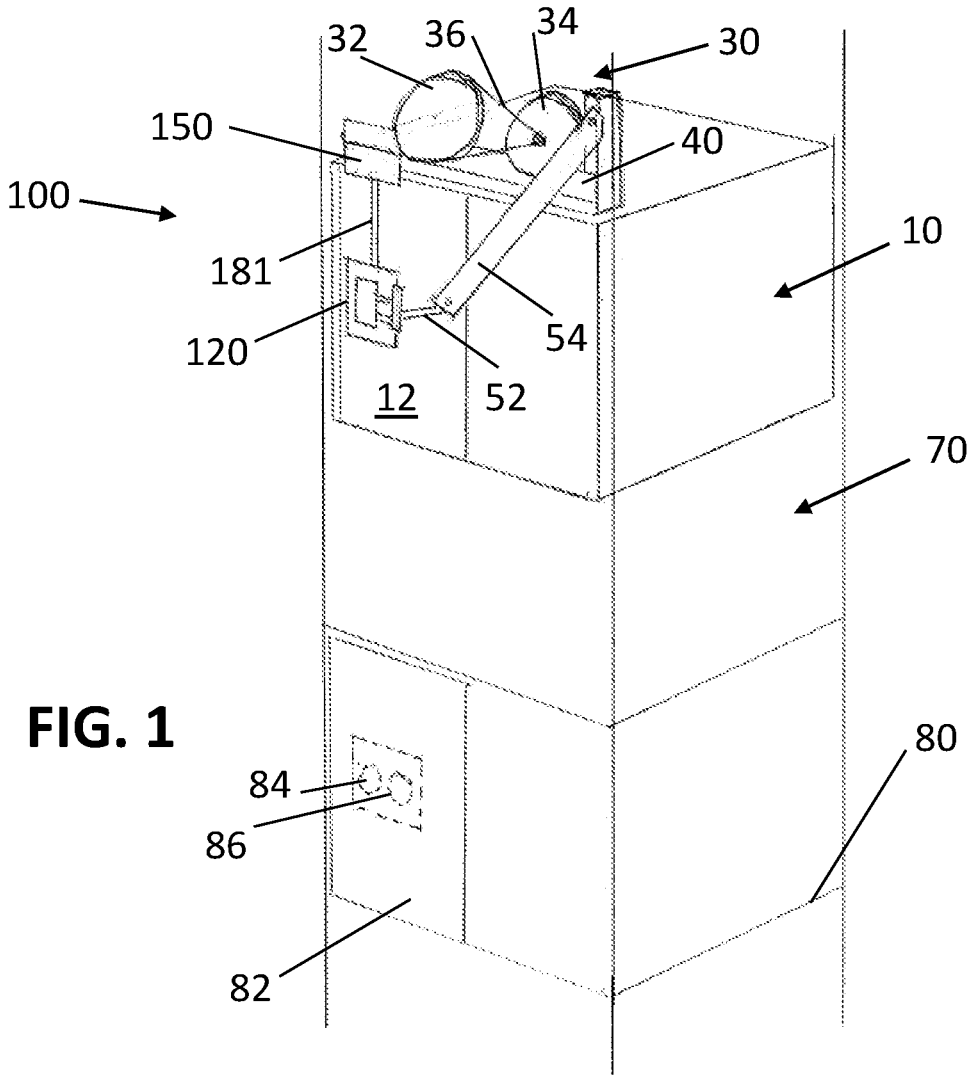
FIG. 1 is a perspective view of a hoistway with an elevator car operatively positioned therein according to one embodiment of the present disclosure.

In one embodiment, control system 100 may be mounted on a car door 12 of an elevator car 10, as shown in FIG. 1. As FIG. 1 illustrates, elevator car 10 includes a single car door 12, and FIGS. 2-5 similarly refer to control system 100 as mounted on car door 12 of elevator car 10. However, such depiction is solely for the sake of brevity, and it should be appreciated that FIG. 1 is but one example implementation and it is contemplated that control system 100 may be mounted on a car with two doors, or other door arrangements. In such other arrangements, components of control system 100 may be similarly structured and be operable in a manner as described for the depicted embodiment described in the present disclosure. Control system 100 is interconnected with an elevator car door operating mechanism 30, as shown in FIG. 1, via lower pivotable lever 52 and upper pivotable lever 54 such that operation of door operating mechanism 30 actuates at least some components of control system 100, as is described in greater detail below. Door operating mechanism 30 is shown mounted on a rail 40 on top of elevator car 10 and includes a gear wheel 32 and pulley 34 interconnected through a chain or belt 36, operable to drive levers 52, 54, though other known door operating mechanisms are compatible with the control systems contemplated by the present disclosure.

Throughout the disclosure, control system 100 may be described with reference to a position of elevator car 10 within a hoistway 70, and whether the elevator car 10 is at a landing 80 corresponding to a floor level of a building or, in some cases, within a predetermined distance from such landing 80, or whether the elevator car 10 is between or otherwise remote from a landing along hoistway 70. In FIG. 1, elevator car 10 is shown as remote from landing 80 and another landing above it (not shown), and thus would be considered remote from a landing. The determinant of whether the elevator car 10 is in the first or second of the above conditions is whether control system 100 can engage a physical object, as is described in greater detail elsewhere in the disclosure. In one specific example, elevator car 10 may be said to be at landing 80 when control system 100 is aligned with rollers 84, 86 mounted on a hoistway door 82, as shown in FIG. 1, where hoistway door 82 provides access to the floor corresponding to landing 80.

Figure 3:
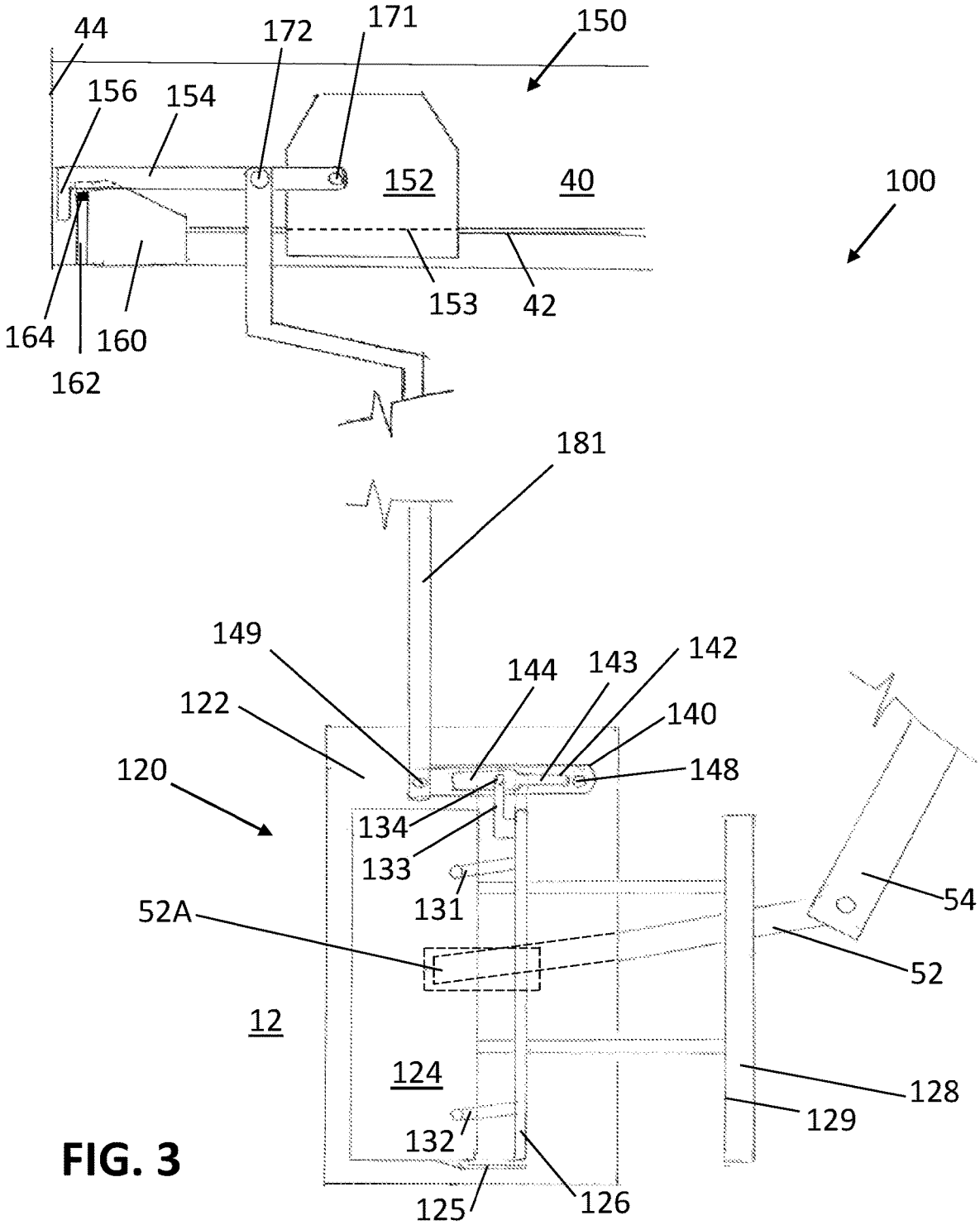
FIG. 3 is a close up side view of an elevator car door control system when an elevator car door is closed and a door operating mechanism is holding a clutch of the system to allow travel of the elevator car according to one embodiment of the disclosure.

Turning to the details of the control system, in one embodiment, control system 100 includes a clutch 120 and an interlock assembly 150 that is operatively connected to clutch 120 via a translation arm 181, as shown in FIG. 3, for example. FIG. 3 illustrates control system 100 in one operating condition, i.e., car door closed and door operating mechanism 30 holding the components of clutch 120 in a travel position, and will be referred to for the purpose of describing the structure of control system 100. Details of what the travel position entails are described in greater detail below. Additionally, it should be recognized that the components of control system 100 are movable based on operation of door operating mechanism 30, some of the other operating conditions being shown in FIGS. 4 and 5 and described with reference to the methods of using control system 100 elsewhere in the disclosure.

Figure 6:
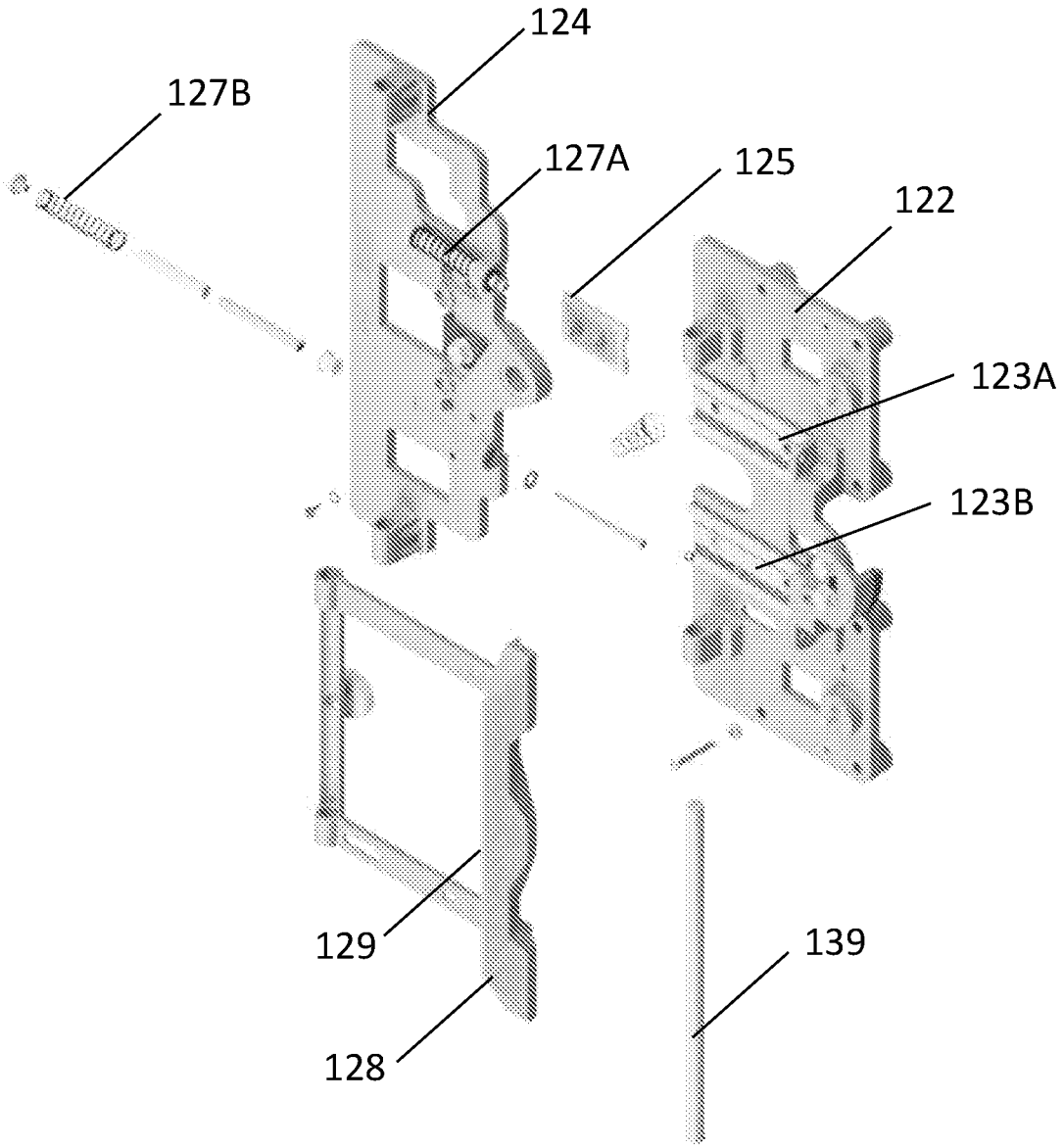
FIG. 6 is an exploded view of certain parts of the elevator car door control system of FIG. 3.

Clutch 120 includes a stationary base 122 that is mounted on car door 12 in a fixed manner and a slidable base 124 that is slidably mounted on the stationary base 122. Clutch 120 also includes a close vane 128 connected to the stationary base. The close vane may be connected to the stationary base through a connection bar 139. A contact surface 129 of close vane 128 is spaced apart from slidable base 124. These components are also shown in FIG. 6. As to the manner slidable base 124 is slidably mounted to stationary base 122, one exemplary arrangement is shown in part in the exploded view of FIG. 6. In some examples, stationary base 122 may include guide rails 123A, 123B, which receive linear bushings fixed to an underside of the slidable base (one linear bushing 125 is shown in FIG. 6) so that linear bushings may slide along guide rails 123A, 123B. Sliding base 124 may also be accompanied by a pair of springs 127A, 127B that control a position of sliding base 124 relative to stationary base 122. Springs 127A, 127B may be biased in an expanded condition such that a force from levers 52, 54 keeps the springs compressed and sliding base 124 at a generally maximum spacing from close vane 128. Greater detail on the operation of the springs and the clutch more generally is provided in the description of the methods of use of the system below.

Figure 5:
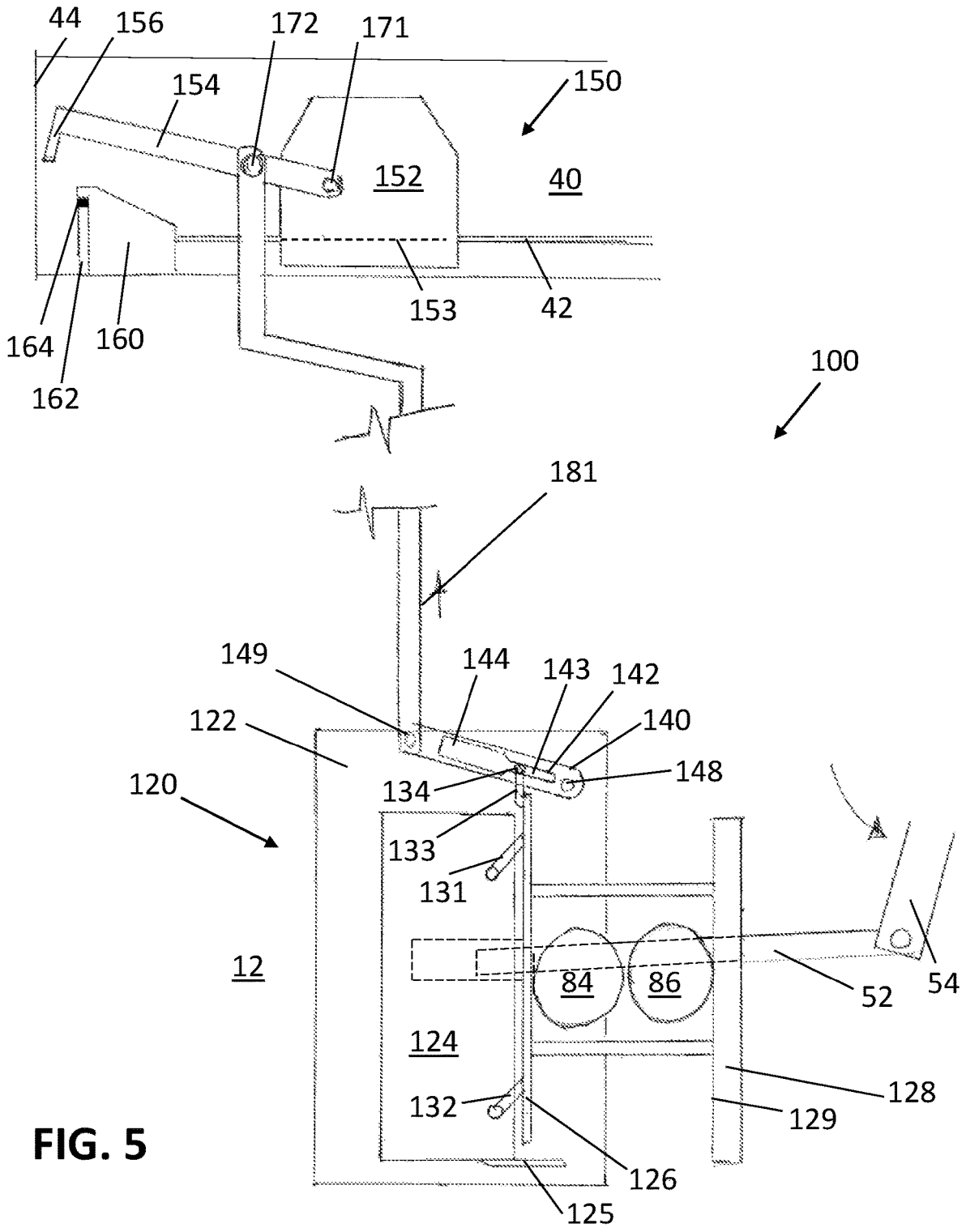
FIG. 5 is a close up side view of the elevator car door control system of FIG. 3 when an elevator car door begins to open in response to the door operating mechanism being operative in a door opening sequence while the elevator car is located within a predetermined range of a hoistway door.

With continued reference to clutch 120, FIG. 3 illustrates a sensing vane 126 hingedly connected to slidable base 124 via pivotable links 131, 132 such that sensing vane 126 may be rotated from a first spacing relative to slidable base 124 as shown in FIG. 3 to a second, smaller spacing relative to slidable base 124 as shown in FIG. 5. Three or more pivotable links, or even a single link, may also be used as an alternative. Sensing vane 126 may be a plate-type structure positioned on the clutch such that a plane through a surface of the plate is perpendicular to a surface of car door 12 to which clutch 120 is mounted. In variations, a shape of the sensing vane may be slightly concave facing the close vane or may have other characteristics that allow for gripping of rollers. Sensing vane 126 is in a default at rest position in FIG. 3 and may be held in a particular at rest vertical position by a vane support 125 that extends from and is fixed to a body of slidable base 124. While a lower end of sensing vane 126 may rest against vane support 125, an upper end opposite the lower end may include a flange 133 or other extension that supports a connected sensing vane pin 134. Sensing vane pin 134 may be oriented such that a longitudinal axis of pin 134 is perpendicular to a plane of the car door 12. It should be appreciated that the particular structure used to connect the sensing vane to the sensing vane pin, and the sensing vane pin itself, may vary from that shown in FIG. 3 and that other attachment locations and structures with other shapes may function for the same purpose. Similar principles apply to the vane support in that other structures or features may be used to hold the sensing vane in at rest position.

Figure 7:
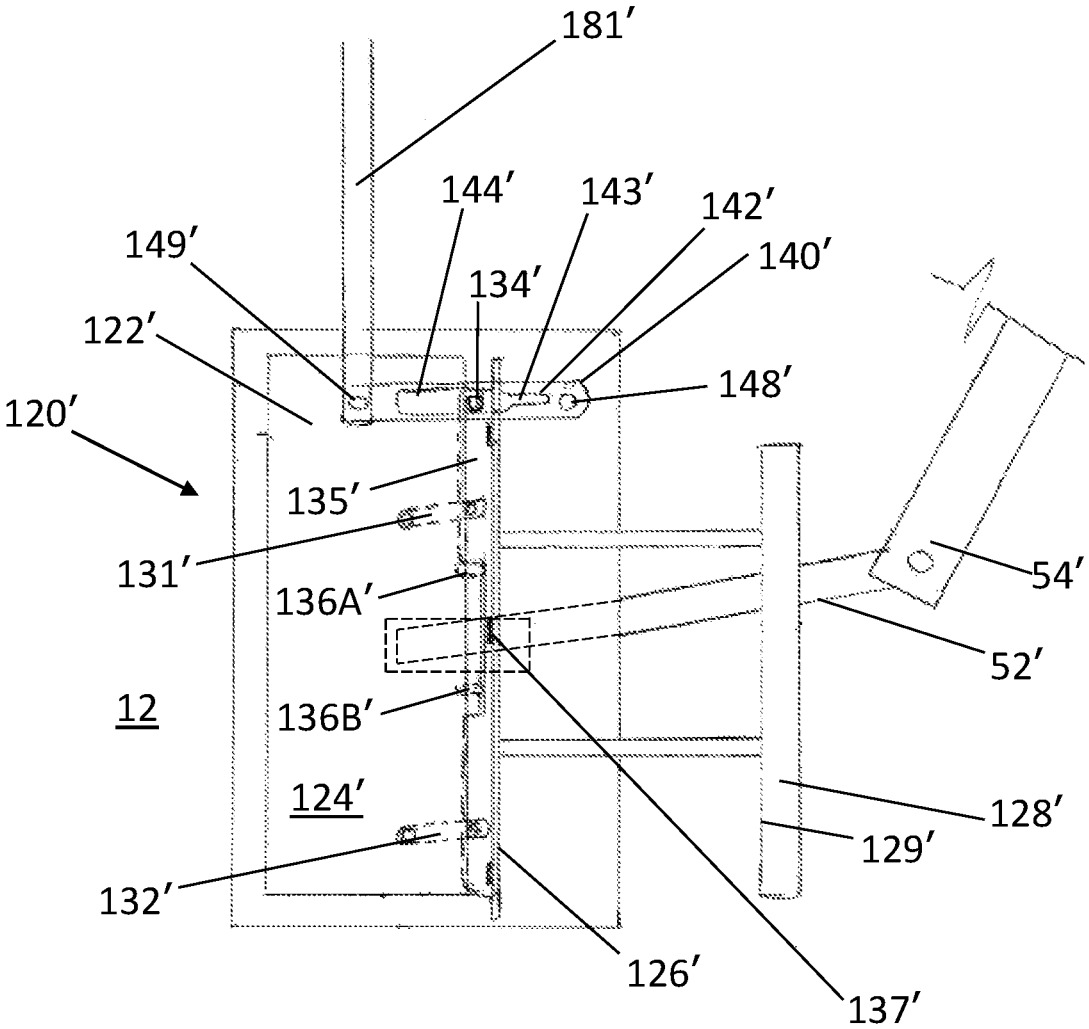
FIG. 7 is a close up side view of an elevator car door control system when an elevator car door is closed and a door operating mechanism is holding a clutch of the system to allow travel of the elevator car according to one embodiment of the disclosure.

A variation of clutch 120 is shown in FIG. 7 and is indicated by reference numeral 120'. In FIG. 7, 100' series reference numerals refer to like elements of 100 series reference numerals in FIG. 3 unless otherwise noted. Clutch 120' includes a stationary base 122' and a slidable base 124' laterally translatable over the stationary base to bring the slidable base closer to or further from close vane 128'. Clutch 120' includes a sensing vane 126' hingedly connected to slidable base 124' via pivotable links 131', 132' such that sensing vane 126' may be rotated from a first spacing relative to slidable base 124' to a second, smaller spacing relative to slidable base 124', in the same manner as shown for clutch 120 as shown in FIGS. 3 and 5. Three or more pivotable links, or even a single link, may also be used as an alternative. Sensing vane 126' includes a plate that faces close vane 128' and a flange 135' extending transversely from one side of the plate, shown in phantom in FIG. 7. The above referenced links may be connected to the flange 135'. A plane through a surface of the plate is perpendicular to a surface of car door 12 to which clutch 120' is mounted while the flange may be parallel to the surface of car door 12. Sensing vane 126' is in a default at rest position in FIG. 7 with flange 135' having a recessed central region so that an edge of flange 135' rests on tab 136A'. When sensing vane 126' is pressed toward slidable base 124', flange 135' rises from its position resting on tab 136A'. Tab 136A' may be fixed to and extend from a surface of slidable base 124', as shown in FIG. 7. An upper end of flange 135' on sensing vane 126' includes a sensing vane pin 134' extending from the flange surface. Sensing vane pin 134' may be oriented such that a longitudinal axis of pin 134' is perpendicular to a plane of the car door 12. An inside face of the plate on sensing vane 126' may include a bumper 137' or bumpers to prevent sensing vane 126' from directly pressing against slidable base 124' when the sensing vane is pressed toward the slidable base.

Returning to FIG. 3, clutch 120 also includes an interlock control arm 140 that is rotatably fixed to stationary base 122 at fixed support 148, which may be a pin, bolt or other anchorage that permits a rotatable connection. At an end of interlock control arm 140 opposite the fixed support is a pivot connection 149 that connects the interlock control arm 140 to translation arm 181, which is further connected to the interlock assembly 150. As depicted in FIG. 3, interlock control arm 140 may be linear in shape along at least part of its length and may include an elongate slot 142. The elongate slot 142 may be sized and located on the length of the interlock control arm so that sensing vane pin 134 is slidably received therein, and that even when a position of sensing vane pin 134 changes relative to interlock control arm 140, pin 134 remains in slot 142. Elongate slot 142 includes a first segment 143 and a second segment 144 that together define a length of the elongate slot, with one end of the first segment being proximal to fixed support 148 and one end of the second segment being proximal to pivot connection 149. A width of the slot along the first segment is narrower than along the second segment, as is shown in FIG. 3. Clutch 120' also includes an interlock control arm 140' that connects to translation arm 181', as shown in FIG. 7. The features of interlock control arm 140' may be as described above for interlock control arm 140.

Returning to the connection between levers 52, 54 and clutch 120, one arrangement for such connection is through lever 52 having a clutch end 52A under clutch 120 that is connected to slidable base 124, as shown in phantom in FIG. 3. In this arrangement, as lever 52 rotates, the clutch end of the lever slides along a slot or another controlled surface under clutch 120, thereby pulling the slidable base 124 along with the clutch end. Because the clutch end moves along a controlled surface, the movement of both the clutch end and the slidable base 124 is a simple translation along a width direction of the clutch, i.e., horizontal direction. The same arrangement may be provided for clutch 120' as shown in FIG. 7.

Interlock assembly 150 is also shown in FIG. 3 with clutch 120, the interlock assembly and the clutch being operatively connected with one another through translation arm 181. The interlock assembly may be used with either clutch 120 or clutch 120'. Interlock assembly 150 may be mounted above elevator car 10, as shown in FIGS. 1 and 3, and may include a support block 152, a locking arm 154 extending from the support block, and a locking frame 160 that holds interlock assembly 150 in a fixed position along a lateral direction in at least one operating condition. Support block 152 includes a track 153 or another rail compatible surface that rests on a flange 42 of rail 40 on the elevator car so that support block 152 is slidable along the rail. Locking arm 154 may include a first end rotatably connected to support block 152 at pivotable connection 171 and at an opposite, free end may include an angled tip 156. In between ends, locking arm 154 is rotatably connected to translation arm 181 at pivotable connection 172. Locking frame 160 may be fixed to a frame of elevator car 10 at a location proximal to the free end of locking arm 154 and includes a barrier 162 positioned so that when locking arm 154 is in a locked position, angled tip 156 or other similar locking feature is blocked from translation along a transverse axis parallel to the rail by the presence of the barrier. Although barrier 162 is shown as a plate-type element in FIG. 3, it may also be a bar supported by vertical arms or any other physical obstruction that prevents locking arm from translating along a lateral or horizontal direction as shown in FIG. 3. On a surface of barrier 162 that contacts locking arm 154 when locking arm is in the locked position is a contact 164 that functions as a switch. When locking arm 154 rests on contact 164, a closed circuit is formed and only then is door operating mechanism 30 operable to allow the elevator car to travel. This is described in greater detail in the description of the method. The components of the interlock assembly provide for mechanical and electrical locking in an integral manner, the mechanical lock provided through the interaction of locking arm 154 and barrier 162 and the electrical lock provided through opening and closing of the circuit that passes between locking arm 154 and contact 164. In some variations, an end of rail 40 adjacent to locking frame 160 may include an end plate 44 to protect locking arm 154.

The car door control system may be varied in many ways. In one example, the clutch of the system may be mountable on a car door such that the slidable base slides in a non-horizontal path to control whether interlock assembly is locked. In some variations, the entire clutch may be mounted at an oblique angle relative to the car door, and in others, the slidable base may be mounted at an angle relative to the stationary base. In the aforementioned examples, an at rest orientation of the interlock control arm may be adjusted to account for the relative position of the other clutch components. In other examples, the sensing vane of the clutch may be connected to the slidable base through a mechanism other than links, such as springs accompanied by additional surface features on the sensing vane to direct sensing vane upward upon contact with hoistway door rollers.

In other examples, the interlock assembly may be varied. In one example, the locking frame may be fixed to the rail of the elevator car or another stationary component above the locking arm and the support block may be positioned in between the free end of the locking arm and the connection of the locking arm to the translation arm. In such an arrangement, the free end of the locking arm rotates downward to release the interlock assembly from the locked position. In other examples, the interlock assembly may be configured to translate along a structure other than a rail, such as along a channel, for example.

In still further examples, it is contemplated that the control systems of the present disclosure may be compatible with door operating mechanisms other than that shown in the depicted embodiment. For instance, the clutch may be adapted to be compatible with a door operating mechanism that does not include a lever.

In another aspect, the present disclosure relates to a method of using control system 100. In one embodiment, the method begins with car door 12 closed and the elevator car 10 in between floors. Initially, locking control system 100 is in a condition as shown in FIG. 3, where sensing vane 126 is spaced from contact surface 129 of close vane 128 to a generally maximal extent. This position ensures that the elevator car 10 smoothly travels through the hoistway 70 without interference from physical objects passing between vanes 126, 128, such as hoistway rollers. The position of vanes 126, 128 separated as shown in FIG. 3 is also referred to as a "travel position" throughout the disclosure. In this method, a door opening mechanism 30 is triggered to initiate a door opening sequence while the elevator car continues to travel or is otherwise positioned between floors. As door opening mechanism 30 begins to operate, levers 52, 54 shown in FIG. 1 begin moving. The trigger for the door opening may be any event that would cause the door to open, and thus the nature of the trigger does not impact the steps of the described method.

Figure 4:
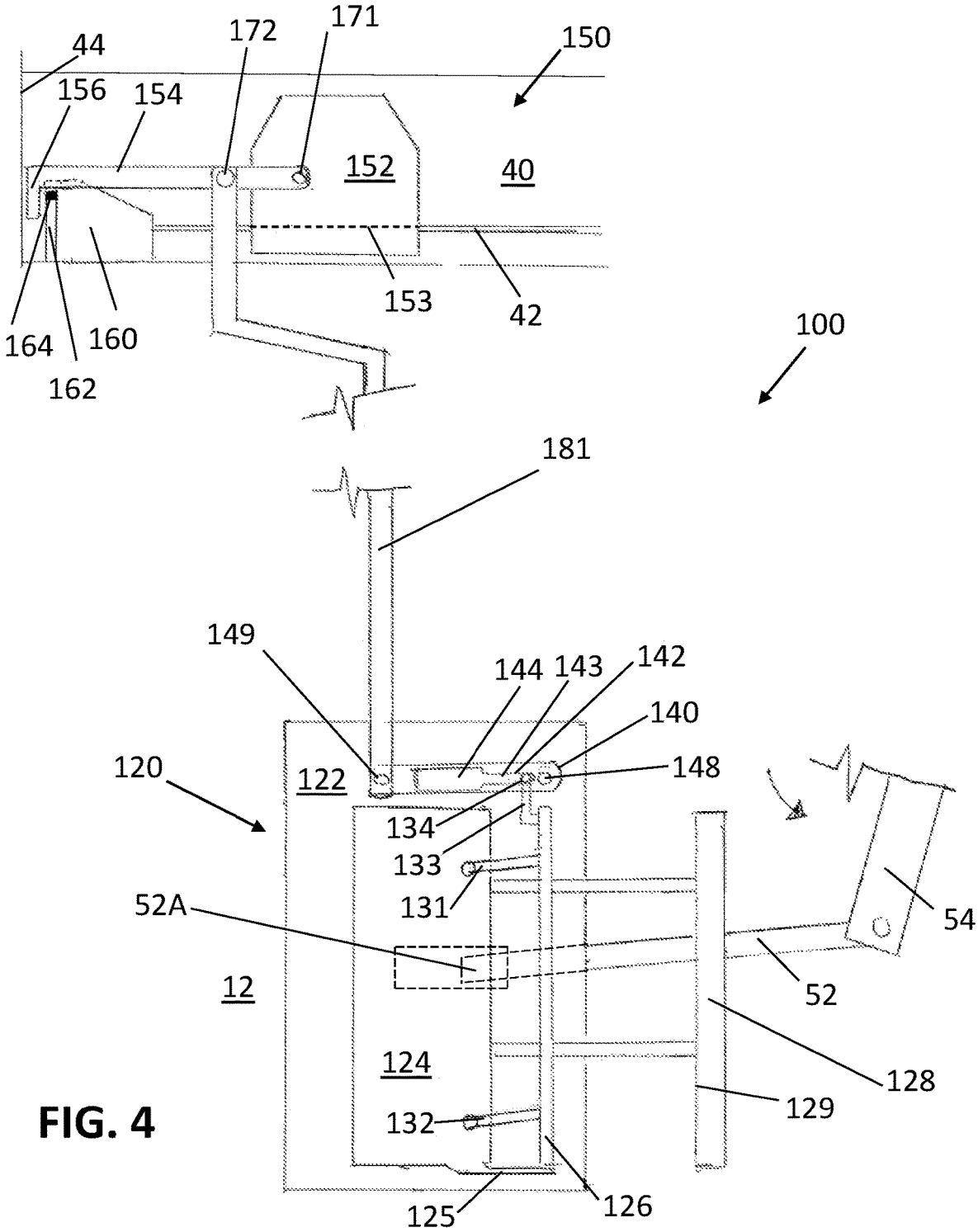
FIG. 4 is a close up side view of the elevator car door control system of FIG. 3 when the elevator car door is closed and the door operating mechanism has commenced a sequence to open the car door while the elevator car is located outside of a predetermined range of a hoistway door.

When the door opening sequence occurs, lever 52 rotates in response to rotation of lever 54 driven by operation of door opening mechanism 30, and slidable base 124 of clutch 120 is laterally translated toward close vane 128 as shown by the change in position of the slidable base 124 between FIGS. 3 and 4. As slidable base 124 translates, springs 127A, 127B of the clutch, where included, return to their biased state due to the reduced force applied against the sliding clutch by the levers 52, 54. The slidable base continues to translate relative to the stationary base until it has reached its maximum extent of lateral translation where the sensing vane and the close vane are generally at their closest extent, a condition referred to as a "grip position" throughout the disclosure. In some examples, close vane 128 may be pivotably connected to stationary base and may pivot outward from the stationary base as the door opening sequence occurs. Such movement of the close vane may facilitate bringing the close vane into horizontal alignment with sliding vane 126. The pivotable connection may be provided by springs operatively connected to the close vane, for example.

The slidable base may be configured to laterally translate across the stationary base by 0.75 inches before reaching a limit on movement at the grip position. In some variations of the control system, the extent of full translation may be greater or less than 0.75 inches to accommodate particular operational conditions, such as the size of the elevator car or the load bearing capacity of the elevator car. It should be appreciated that while the slidable base laterally translates across the above referenced distance, the elevator car door remains closed and does not move with the slidable base.

In this embodiment, because elevator car 10 is in between floors, slidable base 124 will not make contact with any physical object once the full extent of translation is reached, as shown in FIG. 4. At this time, levers 52, 54 can no longer rotate to further advance the door opening sequence, as now not only has the slidable base 124 reached its maximal range of translation, but car door 12 remains fixed relative to the frame of elevator car 10 via interlock assembly 150, also shown in FIG. 4. Because sensing vane 126 has not contacted any physical object to push it toward slidable base 124 and upward relative to slidable base 124, sensing vane pin 134 has moved from an initial position floating within the wide portion in second segment 144 of slot 142 into the narrow portion in first segment 143 of slot 142 without applying any force onto interlock control arm 140 to cause it to rotate about fixed support 148. In this manner, an angulation of interlock control arm 140 remains the same both before and after slidable base 124 travels across its translation extent on the surface of the clutch. As a result, because translation arm 181 remains unmoved during this process, locking arm 154 of interlock assembly 150 remains engaged to barrier 162 of locking frame 160 at all times, preventing support block 152 from sliding with the car door 12 thereby holding door 12 in place. The described restriction on door opening will continue to apply until the elevator car arrives at a landing with a hoistway door, as is described in greater detail below. Further, it should also be appreciated that this mechanism to control door opening does not prevent the elevator from continuing to travel through the hoistway, either before or after the door opening sequence occurs. This is because the locking arm 154 remains physically disposed on contact 164 of switch during the entire sequence so that a closed circuit is maintained at all times, the closed circuit allowing the elevator car to travel.

Figure 2:
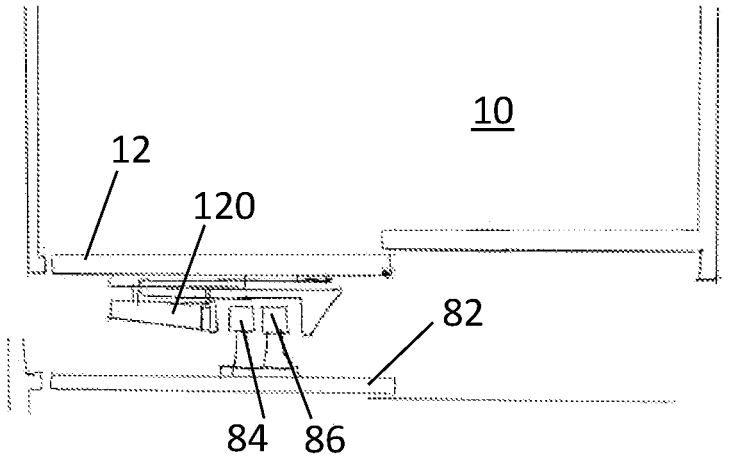
FIG. 2 is a top-down view of the elevator car of FIG. 1 when the elevator car is vertically aligned with a hoistway door of the hoistway that corresponds to a landing.

In another embodiment, the method begins with car door 12 closed and proceeds while the elevator car 10 is aligned with a floor landing. The method begins in the same way here as in the previously described method embodiment, with an initial condition of control system 100 with vanes 126, 128 in a travel position as shown in FIG. 3. However, in this circumstance, elevator car 10 is in vertical alignment with hoistway door 82, and thus clutch 120, or clutch 120', is in vertical alignment with rollers 84, 86 on hoistway door. More specifically, rollers 84, 86 are in between sensing vane 126 and close vane 128, as shown in FIG. 2. As slidable base 124 laterally translates toward close vane 128 while levers 52, 54 rotate, sensing vane 126 contacts roller 84, as shown in FIG. 5. As this occurs, sensing vane 126 is pushed upward and translated laterally toward a body of slidable base 124 with the aid of rotating pivotable links 131, 132. Sensing vane pin 134 undergoes a corresponding movement due to its fixed relationship to sensing vane 126. As this occurs, pin 134 is now higher and pressing against a surface in first segment 143 of elongate slot 142 of interlock control arm 140 at a location at some distance from fixed support 148. Due to the increased elevation of pin 134 and its distance from fixed support 148, this contact with interlock control arm 140 pushes interlock control arm 140 upward, as shown in FIG. 5. In turn, this causes translation arm 181 to shift upward, causing locking arm 154 to pivot about connection 171 to accommodate the raised location of connection 172 due to the rise of translation arm 181. With locking arm 154 pivoting about connection 171 so that angled tip 156 rises, barrier 162 no longer blocks locking arm 154 from laterally translating along an upper surface of elevator car 10. Thus, the sequence initiated by door operating mechanism 30 continues with levers 52, 54 no longer encountering any resistance from interlock assembly 150, and sensing vane 126 presses against rollers 84, 86 to pull interlock assembly 150 with the movement of the levers. As interlock assembly 150 slides along rail 40 above the elevator car 10, door 12 slides open. Additionally, because vanes 126, 128 grip rollers 84, 86, hoistway door 82 is opened in tandem with the opening of door 12.

It should be appreciated that from the time that locking arm 154 loses contact with barrier and contact 164, the circuit for the switch is open, and the elevator will not begin travelling through the hoistway shaft. This safety measure prevents the elevator from travelling while the car door or doors are open.

In yet another embodiment, the method begins with car door 12 and hoistway door open while the elevator car is at a floor with a hoistway door. From this initial condition, the door must fully close through operation of the door operating mechanism 30 before the elevator car 10 may travel. This is because the switch will not provide a closed circuit until locking arm 154 returns to the position shown in FIG. 3, which will only occur once door 12 is fully closed through a process in reverse to that described above. Specifically, slidable base 124 must return to its travel position, thereby moving pin 134 back into a neutral position within second segment 144 of slot 142 so that translation arm 181 descends, and in turn, bringing back locking arm 154 into physical disposal on contact 164. When clutch 120 resets to the travel position, some space is created around the rollers at the hatch door, so no friction between vanes 126, 128 and the rollers will prevent the elevator car from travelling through the hoistway once the switch is closed.

It should be appreciated that the above embodiments may be performed as isolated methods or in combination. For example, one method may include a door opening sequence at a landing followed by a door closing sequence. In another example, a method may include an attempted door opening between landings, a door opening sequence at a landing, and a door closing sequence. Although the above described methods refer to the structure depicted in the figures, it should be appreciated that the described methods may be performed with the variations in the system structure as contemplated by the present disclosure. And, to avoid ambiguity, it should be understood that to the extent not explicitly stated, any one of the methods may be performed with a control system that includes clutch 120 or clutch 120'.

One advantage of the contemplated control system for an elevator car is that it has at least two redundancies built into a single system to prevent the elevator car door from opening under undesirable and possibly dangerous conditions. First, while the elevator is in transit or is otherwise in between landings in a hoistway shaft, the locking arm in the interlock assembly remains engaged to the barrier in the locking frame so that the switch is closed and the tip at the end of the locking arm remains gripped to the barrier. Under such physical conditions, the door is prevented from opening while the elevator car remains free to travel to a floor where the door may open. Second, although the door of the elevator car may normally be opened when the elevator car is at a landing, if the rollers on a hoistway door are not positioned in between the sensing vane and the close vane of the clutch, then the locking arm will not move out of its locked position and the lateral translation of the slidable base of the clutch will not cause the car door to slide open.

This is because the tip of the locking arm will continue to be physically prevented from translating in a lateral direction due to the obstruction presented by the barrier of the locking frame. Further, the prevention of locking arm translation will in turn prevent the interlock assembly from sliding relative to a frame of the elevator car.

Another advantage of the present disclosure includes the incorporation of both a switch and a physical door movement control mechanism into a single structure. The control system also allows for an initiation of a door opening sequence through the lateral translation of the slidable base of the clutch without the need to open the elevator car door at all, thereby not requiring door opening before triggering a lock on door translation. All of the above advantages are based on a system that also protects against door opening in dangerous conditions, i.e., between floors in a building.

Although the disclosure herein has been described with reference to particular embodiments, it is to be understood that these embodiments are merely illustrative of the principles and applications of the present disclosure. It is therefore to be understood that numerous modifications may be made to the illustrative embodiments and that other arrangements may be devised without departing from the spirit and scope of the present disclosure as defined by the appended claims.

The invention claimed is:

1. An elevator car door control system comprising:

a clutch including a stationary base and a slidable base movably attached to the stationary base, the stationary base being adapted for attachment to an elevator car door of an elevator car; and an interlock mechanism including a locking arm operatively connected to the slidable base of the clutch, the locking arm being moveable such that in a first position, the interlock mechanism is fixed relative to the elevator car and in a second position, the interlock mechanism is movable relative to the elevator car, wherein when the elevator car door is in a closed position, a door operating mechanism is operable to perform an initial part of an opening sequence to cause the slidable base to translate relative to the stationary base without moving the elevator car door from the closed position, and wherein when the slidable base translates and contacts a roller on a hoistway door along an elevator shaft housing the elevator car, the locking arm of the interlock moves from the first position to the second position.

2. The elevator car door control system of claim 1, wherein the interlock mechanism further comprises a locking frame that includes a barrier with a switch, the locking frame positioned such that the locking arm contacts the switch when the interlock mechanism is in the first position and the locking arm does not contact the switch when the interlock assembly is in the second position.

3. The elevator car door control system of claim 1, wherein the interlock mechanism further comprises a block assembly adapted to translate along a surface of the elevator car, the locking arm having a first end connected to the block assembly and a second end opposite the first end, the locking arm being rotatable about the first end to move between the first and second position of the interlock mechanism.

4. The elevator car door control system of claim 3, further comprising a translation arm extending between the clutch and the locking arm of the interlock mechanism, the translation arm translating vertically in conjunction with movement between the first and second position of the interlock mechanism.

5. The elevator car door control system of claim 4, wherein the translation arm is connected to the locking arm between the first and second ends of the locking arm.

6. An elevator car door control system for an elevator car comprising:

a clutch comprising:

a stationary base;

a close vane attached to the stationary base; and a slidable base movably attached to the stationary base, the slidable base being moveable from a first position remote from the close vane to a second position proximate the close vane, wherein the slidable base is configured to move from the first position to the second position when operation of a door operating mechanism of the elevator car is initiated;

a sensing vane movably attached to the slidable base, the sensing vane being movable from an expanded position to a contracted position, the contracted position being closer to the slidable base than the expanded position, wherein the sensing vane is configured to move from the expanded position to the contracted position when a physical object applies force against a surface of the sensing vane, and an interlock assembly operatively connected to the sensing vane of the clutch, wherein the interlock assembly is in a locked position preventing a car door of the elevator car from opening when slidable base is in the first position, wherein the interlock assembly is in the locked position when the slidable base is in the second position and the sensing vane is in the expanded position, and wherein the interlock assembly is in an unlocked position when the slidable base is in the second position and the sensing vane is in the contracted position.

7. The elevator car door control system of claim 6, further comprising an interlock control arm rotatably attached to the stationary base and operatively connected to the sensing vane and the interlock assembly such that translation of the slidable base from the first position to the second position and movement of the sensing vane from the expanded to the contracted position causes a first end of the interlock control arm to move toward the interlock assembly thereby causing the interlock assembly to move from the locked to the unlocked position.

8. The elevator car door control system of claim 7, wherein the interlock control arm includes a slot therein and the sensing vane includes an extension with a pin disposed within the slot.

9. The elevator car door control system of claim 8, wherein the slot of the interlock control arm has a first segment and a second segment adjacent to the first segment, the first segment being narrower than the second segment, the segments positioned such that the pin is disposed within the second segment when the slidable base is in the first position and the pin is disposed within the first segment when the slidable base is in the second position.

10. The elevator car door control system of claim 8, wherein the slot is shaped such that when the slidable base is in the second position and the sensing vane is in the contracted position, the first end of the interlock control arm is closer to the interlock assembly than when at least one of the slidable base and the sensing vane is in another position.

11. The elevator car door control system of claim 8, wherein the interlock control arm is oriented in a lowered position when the interlock assembly is in the locked position and in a raised position when the interlock assembly is in the unlocked position.

12. The elevator car door control system of claim 7, further comprising a translation arm operatively connected to the interlock control arm and the interlock assembly, the translation arm configured to translate when the interlock assembly moves between the locked and unlocked positions.

13. The elevator car door control system of claim 6, wherein the sensing vane is connected to the slidable base by a pair of link members such that movement of the sensing vane relative to the slidable base involves lateral translation and vertical translation.

14. The elevator car door control system of claim 6, wherein when the slidable base translates from the first position to the second position and the sensing vane remains in the expanded position, the car door remains closed and does not move with the slidable base.

15. The elevator car door control system of claim 6, wherein movement of the sensing vane from the expanded to contracted position causes a pivotable locking arm of the interlock assembly to disengage from a barrier along a path of translation of the interlock assembly so that the interlock assembly is laterally translatable with the car door relative to the elevator car.

16. The elevator car door control system of claim 6, wherein the interlock assembly includes a switch that forms part of a closed circuit when the interlock assembly is in the locked position and forms part of an open circuit when the interlock assembly is in the unlocked position, the elevator car being prevented from travel through a hoistway when the circuit is open.

17. A method of controlling movement of an elevator car door with a locking control system, the locking control system comprising: a clutch and an interlock mechanism operatively connected to the clutch, the clutch including a stationary base attached to the elevator car door and a slidable base slidably attached to the stationary base, the method comprising:

in response to rotation of a lever operatively connected to the slidable base and controlled by operation of a door operating mechanism, the lever being operatively connected to the door operating mechanism, sliding the slidable base of the clutch relative to the stationary base from a first position at a first distance from a close vane of the clutch to a second position at a second distance from the close vane, the second distance being less than the first distance, wherein when the slidable base approaches the second position and a physical object is located in between the slidable base and the close vane, a sensing vane operatively connected to the slidable base presses against the physical object and the sensing vane moves relative to the slidable base causing the interlock mechanism of the locking control system to release the elevator car door from a locked state to an unlocked state, and wherein when the slidable base approaches the second position and there is no physical object in between the slidable base and the close vane such that the sensing vane does not make contact with a physical object, the sensing vane does not move relative to the slidable base and the interlock mechanism remains in the locked state.

18. The method of claim 17, wherein the sliding of the slidable base occurs in response to arrival of an elevator car including the elevator car door at a floor previously selected through a user interface inside the elevator car.

19. The method of claim 18, wherein when the sensing vane makes contact with the physical object, the physical object is a hatch door roller attached to a hatch door located on an elevator shaft housing the elevator car.

20. The method of claim 17, wherein when the sliding of the slidable base causes the sensing vane to contact the physical object, the sensing vane moves towards the slidable base and upward relative to the slidable base to cause an arm of the interlock mechanism to become unblocked, thereby permitting the interlock mechanism to translate relative to an elevator car supporting the elevator car door in the unlocked state.

* * * * *